United States Patent [19]

Provencher

[11] 4,032,922

[45] June 28, 1977

[54] MULTIBEAM ADAPTIVE ARRAY

[75] Inventor: Joseph H. Provencher, San Diego, Calif.

[73] Assignee: The United States of America as represented by the Secretary of the Navy, Washington, D.C.

[22] Filed: Jan. 9, 1976

[21] Appl. No.: 647,828

[52] U.S. Cl. ..... 343/854; 343/7 A; 343/100 SA

[51] Int. Cl.[2] ..... H01Q 3/26

[58] Field of Search ..... 343/854, 853, 7 A, 100 R, 343/100 SA, 100 LE

[56] References Cited

UNITED STATES PATENTS

| | | | |
|---|---|---|---|
| 3,736,592 | 5/1973 | Coleman | 343/854 |
| 3,868,695 | 2/1975 | Kadak | 343/854 |
| 3,940,770 | 2/1976 | Fassett et al. | 343/854 |
| 3,967,279 | 6/1976 | Zeger | 343/854 |

*Primary Examiner*—Eli Lieberman
*Attorney, Agent, or Firm*—R. S. Sciascia; G. J. Rubens; H. Fendelman

[57] ABSTRACT

An antenna system utilizing the multibeam advantages of the Butler matrix to achieve beam steering with the additional capability of placing nulls in the direction of undesired radiation. The system comprises essentially a Butler matrix with an adaptive circuit interposed between each of the antenna elements and a corresponding one of the hybrid matrices of the Butler matrix. Switch means are also provided for separating the transmit and receive functions.

6 Claims, 3 Drawing Figures

MULTIBEAM ADAPTIVE ARRAY

BACKGROUND OF THE INVENTION

Electronic scanning of corporate structure antennas has been greatly simplified in the number of power dividing and phasing matrices required by the Butler matrix which utilizes the phase shifts occurring in hybrid dividers. The theory, construction and operation of the Butler matrix is well known and is explained in detail in the article "Beam-Forming Matrix Simplifiers Design of Electronically Scanned Antennas" by Jesse Butler and Ralph Lowe, Electronic Design, Apr. 12, 1961. Although the Butler system is effective for accomplishing beam steering it is incapable of minimizing the effects of undesired radiation.

The problem of minimizing undesirable received signals has been approached by the use of "adaptive arrays." The design of an adaptive array is dependent upon the principles of feedback design. The main objective of the array is to minimize an undesired signal or to maximize the desired signal in a given direction. Typically, a broad beam is formed by using a small number of elements. When an undesired signal is incident on the antenna, it is split into in-phase and quadrature components, compared with a reference signal and integrated. If no correlationn is achieved, the weights or excitation coefficients, W, in each of the in-phase and quadrature are adjusted to place a minimum in the direction of the undesired signal. Adaptive antenna systems are further described in the article by Robert L. Riegler and Ralph T. Compton, Jr., "An Adaptive Array for Interference Rejection," Proc. IEEE, Volume 61, No. 6, June 1973 and also in the article "Adaptive Antenna Systems," by B. Widrow, P. E. Mantey, L. J. Griffiths, and B. B. Goode, Proc. IEEE, Volume 55, No. 12, December 1967, both articles incorporated herein by reference. The disadvantage of the adaptive systems heretofore described is basically that the systems are receive only and, thereby, require a separate system for transmission.

SUMMARY OF THE INVENTION

The present invention relates to a low cost, light weight, compact multi-simultaneous beam antenna system for minimizing undesired signals and radiation by self adapting through feedback circuits, for providing multiple beams which can also self adapt and for providing multiple beams for transmission if desired. More specifically, adaptive circuits are used in conjunction with the basic Butler matrix to achieve multiple beam capability, nulling and/or jamming capabilities and high power concentration (directivity) on a target all in a single radiating structure.

Statements of the Objects of the Invention

Accordingly, it is the primary object of the present invention to disclose a single antenna system providing a plurality of simultaneous beams for receive, null steering in selected directions and maximum transmit power in selected directions.

Other objects, advantages and novel features of the invention will become apparent from the following detailed description of the invention when considered in conjunction with the accompanying drawings.

DESCRIPTION OF THE PREFERRED EMBODIMENT

Figure 1:
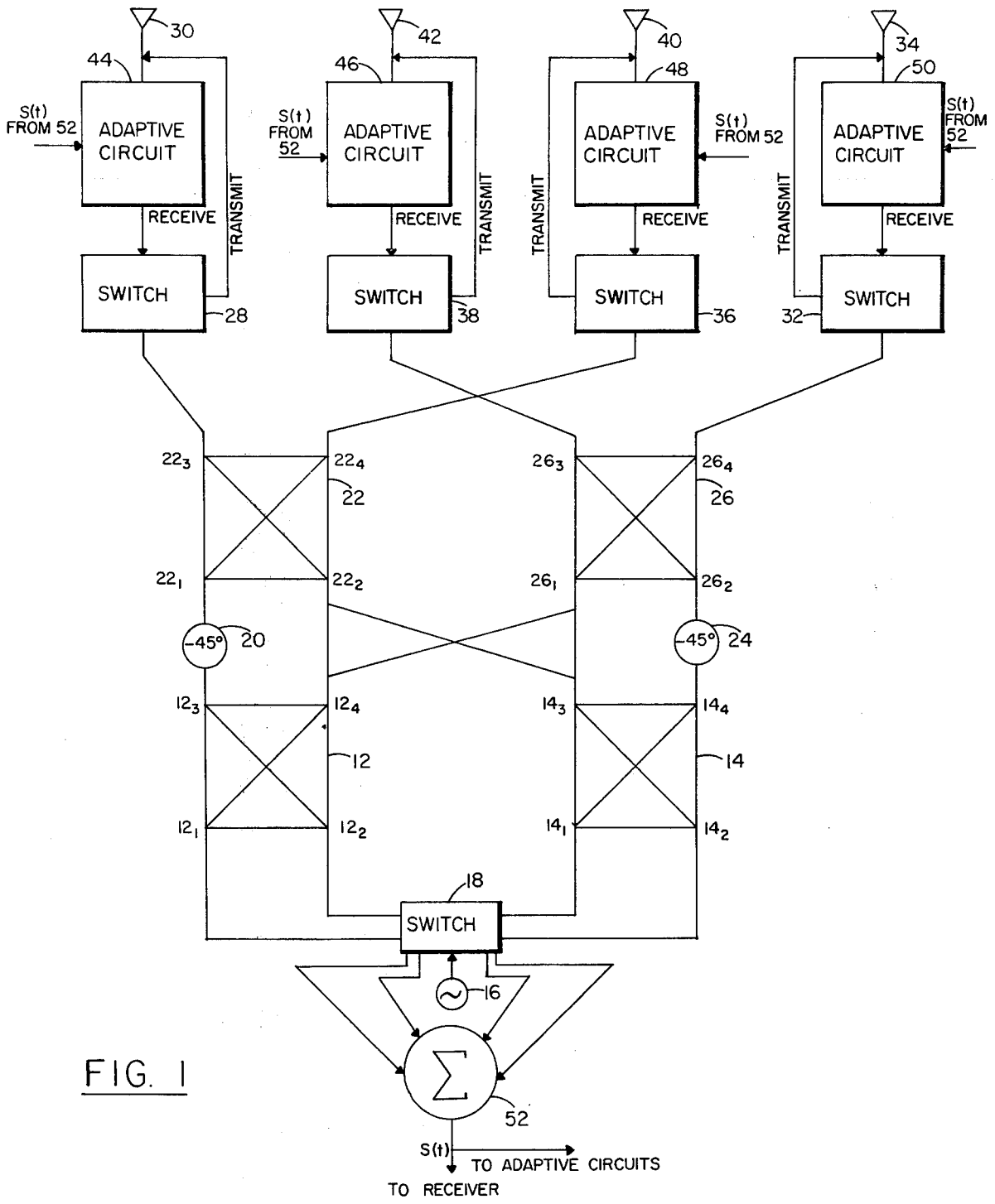
FIG. 1 is a circuit schematic diagram of the multibeam adaptive array of the present invention.

Referring now to FIG. 1 there is illustrated the antenna system 10 of the present invention. Beginning with the Butler matrix portion, the antenna system 10 includes first and second 90° hybrid couplers 12 and 14 having input ports denoted as port $12_1$, port $12_2$, port $14_1$ and port $14_2$. The input ports are connected to microwave signal generator 16 through switch 18 which may comprise a T-R switch, a diode switch, a ferrite switch, a reed switch, a multiple pole muliple throw switch or any other switching means for permitting selective inputs to any of the input ports, to all the input ports or any combination thereof and that has the capability of isolating the generator 16 from the ports $12_1$, $12_2$, $14_1$ and $14_2$ during the receive mode operation. Port $12_3$ is connected through 45° phase shifter 20 to port $22_1$ of 90° hybrid coupler 22 and, likeise, port $14_4$ or 90° hybrid coupler 14 is connected through 45 degree phase shifter 24 to port $26_2$ of 90° hybrid 26. Ports $12_4$ and $14_3$ are cross connected to the ports $26_1$ and $22_2$, respectively, as illustrated. Port $22_3$ or 90° hybrid 22 is coupled through switch 28 to the input of antenna element 30. Similarly, port $26_4$ is coupled through switch 32 to the input of radiating antenna element 34. Ports $22_4$ and $26_3$ are cross coupled through switches 36 and 38, respectively, to radiating antenna elements 40 and 42. Switches 28, 32, 36 and 38 may comprise T-R switches or multi-pole multi-throw switches, diode switches, ferrite switches, or reed switches with the appropriate associated control circuits and serve to isolate the transmit and receive functions of the system 10.

The operation of the device thus far described is the same as that of a conventional Butler matrix. Briefly and by way of example, assuming an input at port $12_1$ from switch 18, the input signal would be divided into two equal outputs at ports $12_3$ and $12_4$ with a 90° phase shift being introduced by the hybrid 12 therebetween. The signal departing from port $12_3$ would be further phase shifted by the phase shifter 20 and further split and phase shifted by the 90° hybrid coupler 22 between ports $22_3$ and $22_4$. Similarly, the signal departing from port $12_4$ would be inputted to port $26_1$ and divided and phase shifted by 90° hybrid 26 between ports $26_3$ and $26_4$. The signals then pass through the respective switches 28, 32, 36 and 38, propagate along the path denoted as "TRANSMIT" and are radiated by the respective antenna elements 30, 34, 40 and 42, the radiated signals being separated by equal phase shifts. It is to be understood that the Butler matrix shown in FIG. 1 and described herein is exemplary only and that any size Butler matrix could be utilized in the present invention, i.e., the system 10 of the present invention could be built for an array having 8, 16 . . . $2^N$ (N = integer), radiating elements.

The remaining elements of the system 10 of the present invention will now be described. An adaptive circuit 44 is connected between radiating element 30 and switch 28. Similarly, adaptive circuits 46, 48 and 50 are coupled between radiating elements 42, 40 and 34 and the respective switches 38, 36 and 32. An adaptive circuit is defined herein to be any circuit for tending to minimize an undesired signal. Each of the adaptive circuits 44, 46, 48 and 50 receives a feedback signal from summer 52, the inputs to which are derived from ports $12_1$, $12_2$, $14_1$, and $14_2$ during the receive mode of operation.

Figure 2:
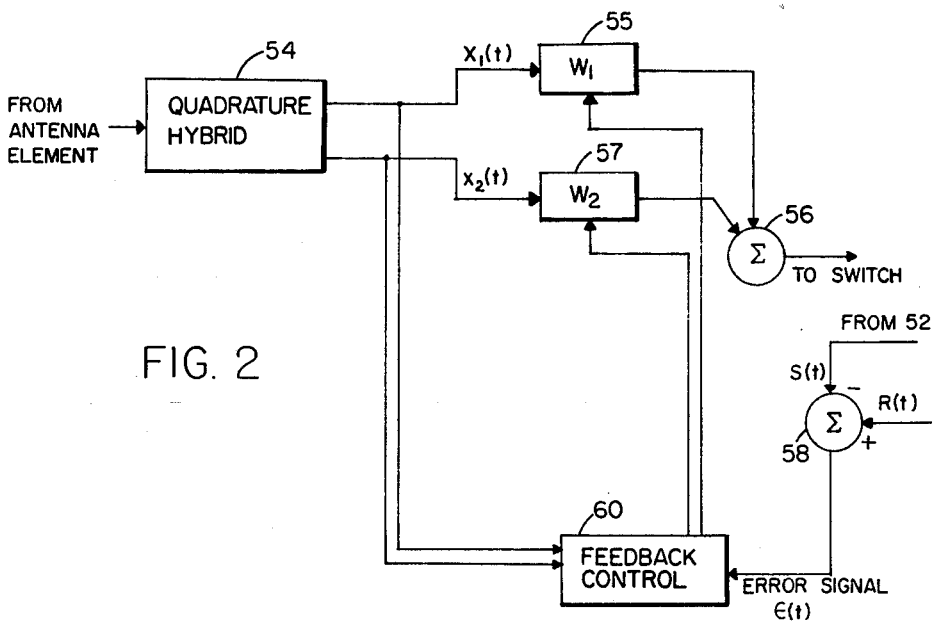
FIG. 2 is a circuit schematic diagram of an exemplary adaptive circuit suitable for use in the present invention.

The adaptive circuits are well known and are shown and described in detail in the aforementioned IEEE articles except for the modification necessitated by the unique combination of the present invention described below. Referring now to FIG. 2 there is illustrated a well known adaptive circuit modified as described below that is suitable for use in the present invention. The signal received by the appropriate antenna element is inputted to quadrature hybrid 54 which splits the signal into n-phase and quadrature components $x_i(t)$. Each $x_i(t)$ is weighted by a real coefficient $w_i$ at units 55 and 57. Whereas the prior art adaptive circuits use a single summer to sum the inputs from each of the weighting units $w_i$ from all of the antenna elements in the system, the adaptive circuit for purposes of the present invention is modified such that a separate summer 56 is used in each of the adaptive circuits 44, 46, 48 and 50. Rather than receiving signal inputs from each of the antenna elements as in the prior art adaptive circuits, the summers 56 utilized in the present invention each receive inputs only from their corresponding antenna element, i.e., summer 56 in adaptive circuit 44 receives inputs only from the in-phase and quadrature channels derived from antenna element 30, summer 56 in adaptive circuit 46 receives input signals only from the in-phase and quadrature channels derived from antenna element 42, etc.

The outputs of each adaptive circuit 44, 46, 48 and 50 are processed through the corresponding switches 28, 38, 36 and 32, during the receive mode of operation, through the Butler matrix and outputted at ports $12_1$, $12_2$, $14_1$ and $14_2$ from which they are inputted through switch 18 to summer 52 which outputs the sum signal $S(t)$. The difference between the array output $S(t)$ and a reference signal $R(t)$ is the error signal $\epsilon(t)$ and is formed by the substraction unit 58. The error signal $\epsilon(t)$ is used in the feedback control network 60 that adjusts the weights $w_i(t)$. The feedback control may be designed to adjust the antenna excitation coefficients (weights) so that the mean square value of $\epsilon(t)$ is minimized. This has the effect of forcing the output of the array to approximate the reference signal $R(t)$. It is noted, however, that any other adaptive algorithm could be used in the present invention.

Figure 3:
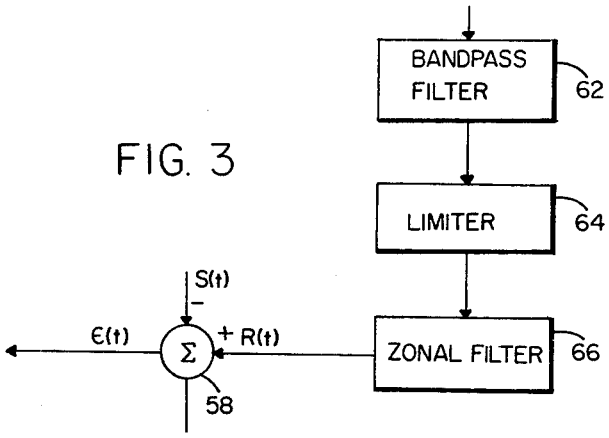
FIG. 3 is a block diagram of a reference signal generator suitable for use in the present invention.

Thus, during the receive mode of operation the adaptive circuits 44, 46, 48 and 50 are, by operation of the corresponding switches 28, 38, 36 and 32, in the receive signal processing network. Each antenna element receives a portion of the received signal which is matched with the reference signal generated. The reference signal $R(t)$ may be generated by any known technique. In practical communication systems, this signal is obtained by processing the array output $S(t)$. The details of this processing depend on the particular design problem. For example, if it were desirable to reject interference whose bandwidth is much wider than that of the desired signal, a processing loop such as that illustrated in FIG. 3 could be utilized. The bandpass filter 62 is chosen to be wide enough to pass the desired signal but not wide enough for the full interference bandwidth. The limiter 64 establishes the reference signal amplitude and the zonal filter 66 removes unwanted spectral products from the limiter. Interference spectral components outside the filter pass band will not be present in the reference signal. Hence the error signal will contain these components. As a result, the array will null the interference. During transmission, switch 18 couples the microwave signal generator 16 to the Butler matrix which is coupled to the output antenna element by means of switches 28, 38, 36 and 32 by means of the alternate TRANSMIT path around the adaptive circuits as illustrated in FIG. 1.

Obviously many modifications and variations of the present invention are possible in the light of the above teachings. It is therefore to be understood that within the scope of the appended claims the invention may be practiced otherwise than as specifically described.

I claim:

1. A system comprising:

a Butler matrix including at least a plurality of input ports, a first plurality of hybrid couplers coupled to said input ports, a plurality of phase shifters coupled to said first plurality of hybrid couplers, a second plurality of hybrid couplers coupled to said plurality of phase shifters;

a plurality of antenna elements; and a plurality of adaptive means, each being coupled between one of said plurality of antenna elements and a corresponding one of said second plurality of hybrid couplers for minimizing the amplitude of an undesired signal received by said one of said plurality of antenna elements to which it is coupled, each adaptive means including means for comparing said received signal with a reference signal to develop an error signal for feedback control.

2. The system of claim 1 wherein said second plurality of hybrid couplers includes a plurality of output ports and further including a plurality of output ports and further including a plurality of switch means, each for selectively coupling one of said output ports directly to a corresponding one of said plurality of antenna elements during transmission and each for selectively coupling one of said plurality of antenna elements through a corresponding one of said plurality of adaptive means, during reception, to a corresponding one of said output ports.

3. The system of claim 2 further including:

a signal summer connected to said plurality of input ports for outputting a signal indicative of the sum of the signals received by each of said antenna elements as processed by said plurality of adaptive means.

4. In a Butler matrix and antenna system wherein said Butler matrix includes first and second pluralities of input-output ports and wherein said antenna system includes a plurality of antenna elements, each of said antenna element being associated with a corresponding one of said second plurality of input-output ports, the improvement comprising:

a plurality of adaptive circuit means, each coupling one of said second plurality of input-output ports to its said associated antenna element for minimizing the amplitude of an undesired signal received by said associated antenna element, each adaptive circuit means including means for comparing said received signal with a reference signal to develop an error signal for feedback control.

5. In the Butler matrix and antenna system of claim 4, the improvement further comprising:

a plurality of switch means each for coupling one of said plurality of antenna elements thorugh one of said plurality of adaptive circuit means to the corresponding one of said second plurality of input-output ports during reception and each for coupling one of said plurality of antenna elements directly to a corresponding one of said second plurality of input-output ports during signal transmission.

6. In the Butler matrix and antenna system of claim 5, the improvement further comprising a summer connected to said first plurality of input-output ports.

* * * * *